US006502817B2

(12) United States Patent
Kawaguchi

(10) Patent No.: US 6,502,817 B2
(45) Date of Patent: Jan. 7, 2003

(54) SHEET FEEDER

(75) Inventor: Takahiro Kawaguchi, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 53 days.

(21) Appl. No.: 09/805,356

(22) Filed: Mar. 13, 2001

(65) Prior Publication Data

US 2001/0022423 A1 Sep. 20, 2001

(30) Foreign Application Priority Data

Mar. 17, 2000 (JP) ..... 2000-076975

(51) Int. Cl.[7] ..... B65H 1/26
(52) U.S. Cl. ..... 271/164; 271/119
(58) Field of Search ..... 271/162, 164, 271/119

(56) References Cited

U.S. PATENT DOCUMENTS 5,139,252 A * 8/1992 Morita et al. ..... 271/117
5,277,418 A * 1/1994 Jones et al. ..... 271/145
5,651,540 A * 7/1997 Watanabe et al. ..... 271/10.12
5,908,189 A * 6/1999 Flores et al. ..... 221/186

FOREIGN PATENT DOCUMENTS

JP 10-329961 12/1998

* cited by examiner

*Primary Examiner*—Christopher P. Ellis
*Assistant Examiner*—Mark A. Deuble
(74) *Attorney, Agent, or Firm*—Frishauf, Holtz, Goodman & Chick, P.C.

(57) ABSTRACT

A sheet feeder includes a cassette for storing a stack of sheets and pushing up the sheets, a main body case having a port through which the cassette is detachably attached, and a feeding mechanism for feeding each sheet in a feeding direction. The feeding mechanism includes a roller shaft disposed above the cassette attached to the internal place of the port and extending perpendicularly to the feeding direction from a side wall of the case, a pickup roller rotated for taking out the uppermost sheet, and a rise-spoiling member attached to the roller shaft, for spoiling a rise of the sheets when the cassette is withdrawn from the port. Particularly, the rise-spoiling member extrudes downward to a position below an upper edge of the port and extends from the pickup roller to the vicinity of the side wall of the case.

6 Claims, 3 Drawing Sheets

SHEET FEEDER

CROSS-REFERENCE TO RELATED APPLICATIONS

This application is based upon and claims the benefit of priority from the prior Japanese Patent Application No. 2000-076975, filed Mar. 17, 2000, the entire contents of which are incorporated herein by reference.

BACKGROUND OF THE INVENTION

This invention relates to an image forming apparatus such as a facsimile device and copying machine, and more particularly to a sheet feeder for taking out a recording sheet from a sheet storage cassette which is detachably attached to the image forming apparatus.

In recent years, most facsimile devices are capable of printing images on recording sheets of plain paper previously cut into a preset size. A typical one of the facsimile devices includes a sheet storage cassette for storing a stack of recording sheets, a cassette attachment port formed in the side wall of a case of the facsimile device to detachably attach the sheet storage cassette thereto, a sheet feeding mechanism for taking out recording sheets one by one from the sheet storage cassette attached to the internal place of the cassette attachment port, and a printing unit for printing an image on the recording sheet fed by the sheet feeing mechanism in an electrophotographic process.

The sheet storage cassette generally includes a sheet tray having a preset depth, a supporting plate which supports the recording sheets received in the sheet tray and is rotatable about one end thereof to allow movement of the other end to the open plane of the sheet tray, a spring member for pushing up the supporting plate by elastic force, a hooking member for hooking the supporting plate pushed down against the elastic force of the spring member, and a releasing member for releasing the hooking member when the sheet storage cassette is attached to the internal place of the cassette attachment port. The sheet feeding mechanism includes a pickup roller arranged above the sheet storage cassette attached to the internal place of the cassette attachment port so as to face the other end side of the supporting plate of the sheet storage cassette and a driving unit for driving the pickup roller. The pickup roller is mounted on a roller shaft rotatably supported by a pair of bearing holes formed in the side walls of the case of the facsimile device. The user puts a stack of recording sheets on the supporting plate of the sheet storage cassette, pushes down the supporting plate together with the recording sheets, and then inserts the sheet storage cassette into the cassette attachment port in a state where the recording sheets are fully received within the sheet tray of the sheet storage cassette. When the sheet storage cassette is attached to the internal place of the cassette attachment port, the releasing member releases the hooking member so as to cause the uppermost one of the recording sheets to abut against the pickup roller. Therefore, when the pickup roller is rotated by the driving force of the driving unit, the uppermost recording sheet is taken out from the sheet storage cassette and fed to the printing unit.

Conventionally, the cassette attachment port is formed in the side wall which lies in the same plane as one of the bearing holes in some cases in order to horizontally attach and detach the sheet storage cassette in a direction perpendicular to the sheet feeding direction of the sheet feeding mechanism. In this case, the bearing holes are arranged above the cassette attachment port and a distance between the bearing hole and the cassette attachment port is set large so that the strength of the side wall of the case will not become insufficient for holding the roller shaft supported by the bearing hole.

However, the above construction tends to cause a problem when recording sheets are supplemented before the sheet storage cassette becomes completely empty. That is, if the sheet storage cassette having some recording sheets left received therein is withdrawn from the cassette attachment port, end portions of the recording sheet rise and are caught by the side wall between the bearing hole and the cassette attachment port and a sheet jam which makes it difficult to supplement recording sheets may occur in some cases. At this time, if an attempt is made to forcedly pull out the sheet storage cassette, the recording sheets may be separated from the sheet storage cassette or torn. In order to avoid this, it is necessary to withdraw the sheet storage cassette while manually holding down the recording sheets together with the supporting plate by use of a gap between the sheet storage cassette and the cassette attachment port. This is an extremely troublesome task for the user.

BRIEF SUMMARY OF THE INVENTION

An object of this invention is to provide a sheet feeder capable of reliably preventing occurrence of a sheet jam caused when the sheet storage cassette having sheets received therein is withdraw from the cassette attachment port.

According to this invention, there is provided a sheet feeder comprising a sheet storage cassette for storing a stack of sheets and pushing up the sheets by elastic force; a case having a cassette attachment port through which the sheet storage cassette is detachably attached; and a feeding mechanism for feeding each of the sheets stored in the sheet storage cassette attached to an internal place of the cassette attachment port in a sheet feeding direction substantially perpendicular to an attachment and detachment direction of the sheet storage cassette; wherein the feeding mechanism includes a roller shaft disposed above the sheet storage cassette attached to the internal place of the cassette attachment port and extending in the attachment and detachment direction of the sheet storage cassette from a side wall of the case, a pickup roller rotated for taking out the uppermost one of the sheets stored in the sheet storage cassette attached to the internal place of the cassette attachment port, and a rise-spoiling member attached to the roller shaft, for spoiling a rise of the sheets when the sheet storage cassette is withdrawn from the cassette attachment port, the rise-spoiling member extruding downward to a position below an upper edge of the cassette attachment port and extending from the pickup roller to the vicinity of the side wall of the case.

In the above sheet feeder, the rise-spoiling member extrudes downward to a position below an upper edge of the cassette attachment port and extends from the pickup roller to the vicinity of the side wall of the case. That is, the rise-spoiling member holds down the sheets uniformly in a range from the pickup roller to vicinity of the side wall of the case when the sheet storage cassette is withdrawn from the cassette attachment port. As a result, the end portions of each sheet do not rise above the cassette attachment port, and are not be caught by the side wall of the case. Accordingly, occurrence of a sheet jam can be prevented.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

There will now be described a facsimile device according to an embodiment of this invention with reference to the accompanying drawings. The facsimile device is an image processing apparatus for storing a stack of recording sheets of plain paper previously cut into a preset size and printing an image on each of the recording sheets by an electrophotographic process.

Figure 1:
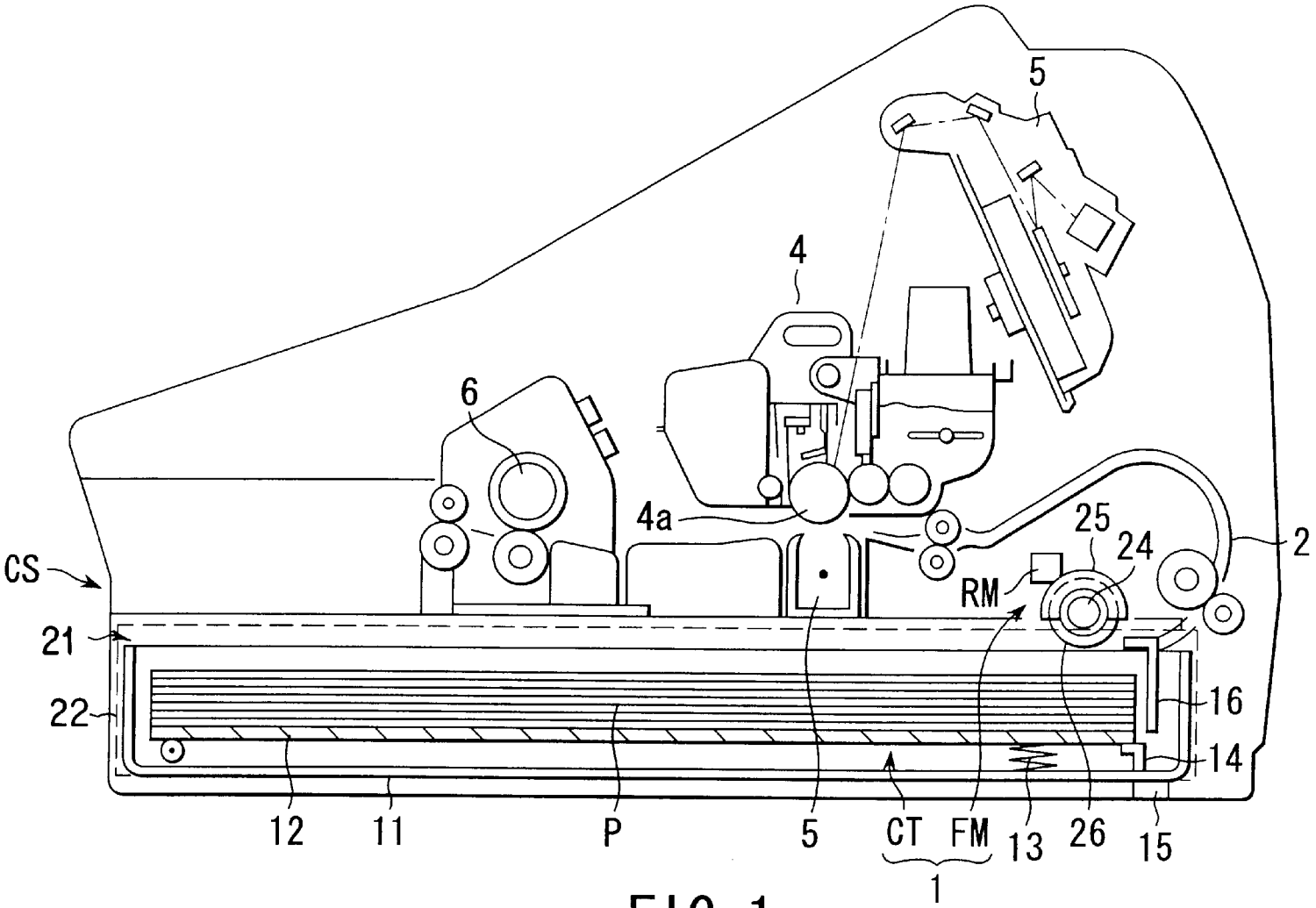
FIG. 1 is a view schematically showing the internal structure of a facsimile device according to one embodiment of this invention.

FIG. 1 schematically shows the internal structure of the facsimile device. The facsimile device includes a sheet feeder 1, guide 2, laser exposing unit 3, developing process unit 4, transfer unit 5 and fixing unit 6. The components 1, 2, 3, 4, 5, 6 are all received in a main body case CS. The sheet feeder 1 includes a sheet storage cassette CT which stores a stack of recording sheets P and is detachably attached to a receiving section 21 occupying the lower space of the main body case CS, and a feeding mechanism FM for taking out the recording sheets P one by one from the sheet storage cassette CT and feeding the taken-out recording sheet toward the guide 2. The sheet storage cassette CT is horizontally attached and detached via a cassette attachment port 22 formed in a side wall W of the main body case CS. The guide 2 guides the recording sheet P fed from the sheet feeder 1 to a printing unit constructed by the developing process unit 4 and transfer unit 5. The developing process unit 4 has a photosensitive drum 4*a* arranged in the central position of the main body case CS and serving as an image carrier. The laser exposing unit 3 is arranged above the developing process unit 4 to form an electrostatic latent image on the photosensitive drum 4*a* by irradiation of a laser beam corresponding to image information. The developing process unit 4 supplies toner to the photosensitive drum 4*a* as a developer, thereby developing the electrostatic latent image as a toner image formed of the toner adhered thereto. The transfer unit 5 is arranged below the photosensitive drum 4*a* to transfer the toner image on the recording sheet fed via the guide 2. The fixing unit 6 fixes the toner image transferred by the transfer unit 5 with a use of heat and pressure.

Further, the sheet feeder 1 is explained more in detail. The sheet storage cassette CT is inserted into or removed from the cassette attachment port 22 in an attachment and detachment direction D1 shown in FIG. 2. The sheet feeding mechanism FM takes out the recording sheet P from the sheet storage cassette CT in a sheet feeding direction D2 perpendicular to the attachment and detachment direction D1 in a state where the sheet storage cassette CT is attached to the receiving section 21, that is an internal place of the cassette attachment port 22.

The sheet storage cassette CT includes a rectangular sheet tray 11 generally having a preset depth, a supporting plate 12 which supports the recording sheets P received in the sheet tray 11 and rotatable about one end thereof to allow movement of the other end to the open plane of the sheet tray 11, an elastic member 13 for pushing up the supporting plate 12, a hooking pawl 14 for hooking the supporting plate 12 pushed down against the elastic force of the elastic member 13, a releasing member 15 for releasing the hooking pawl 14 when the sheet storage cassette CT is attached to the receiving section 21, i.e., the internal place of the cassette attachment port 22, and a separation pawl 16 fixed to the sheet tray 11 on the other end side of the supporting plate 12 and projecting to the opening plane of the sheet tray 11 to contact the uppermost one of the recording sheets P. The sheet storage cassette CT is attached to the receiving section 21 with the one end of the supporting plate 12 disposed adjacent to the guide 2. The elastic member 13 is, for example, a compression spring connected to the sheet tray 11 and the supporting plate 12 on the other end side of the supporting plate 12. The separation pawl 16 regulates the highest position of the supporting plate 12 by contacting the other end of the supporting plate 12, so that the other end of the supporting plate 12 can be prevented from rising above the separation pawl 16. When the sheet storage cassette CT is used, a stack of recording sheets P is first placed on the supporting plate 12 of the sheet storage cassette CT, and pushed down together with the supporting plate 12 against the elastic force from the compression spring of the elastic member 13 to compress the compression spring. The sheet storage cassette CT is inserted into the cassette attachment port 22 after the recording sheets P are fully received below the opening plane of the sheet tray 11 in the sheet storage cassette CT and the supporting plate 12 is hooked by the hooking pawl 14.

Figure 5:
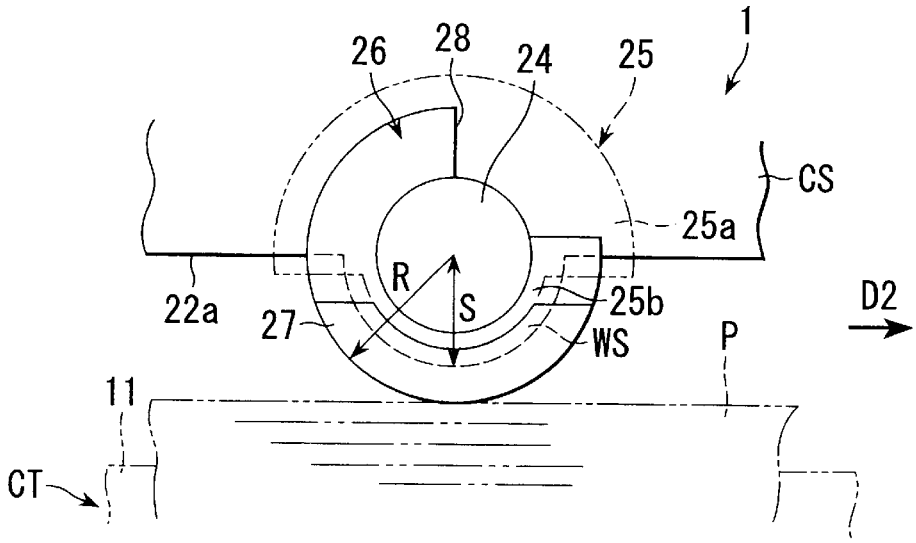
FIG. 5 is a view showing the cross sectional structure of the sheet feeder in a plane perpendicular to the axis of the roller shaft shown in FIG. 2.

The sheet feeding mechanism FM includes a pair of bearing holes 23 which are formed in the side walls W of the main body case CS and located at positions above the receiving section 21 and adjacent to the guide 2, a roller shaft 24 rotatably supported by the pair of bearing holes 23, a pickup roller 25 mounted on the roller shaft 24, and a driving unit RM for rotating the pickup roller 25 via the roller shaft 24. The axial direction of the roller shaft 24 is parallel to the attachment and detachment direction D1 of the sheet storage cassette CT and perpendicular to the sheet feeding direction D2 of the recording sheets P. The pickup roller 25 is able to abut against the uppermost one of the recording sheets P in a state where the sheet storage cassette CT has been attached to the receiving section 21 via the cassette attachment port 22 and the releasing member 15 has released the hooking pawl 14. The pickup roller 25 is a cylindrical member having a cross section of eccentric cam form obtained by a combination of a large-diameter portion 25*a* and a small-diameter portion 25*b* as shown in FIG. 5 and is rotated together with the roller shaft 24 by the driving force from the driving unit RM. The large-diameter portion 25*a* abuts against the uppermost one of the recording sheets P received in the sheet storage cassette CT at the time when the pickup roller 25 rotates to take out the uppermost recording sheet P from the sheet storage cassette CT. The circumferential surface of the large-diameter portion 25*a* is corrugated in a gear form by a plurality of grooves parallel to the axis of the roller shaft 24 so as to permit the recording sheet P to be easily taken out. The small-diameter portion 25*b* faces the uppermost one of the recording sheets P received in the sheet storage cassette CT without being brought into contact with the same at the time when the rotation of the pickup roller 25 stops.

Figure 2:
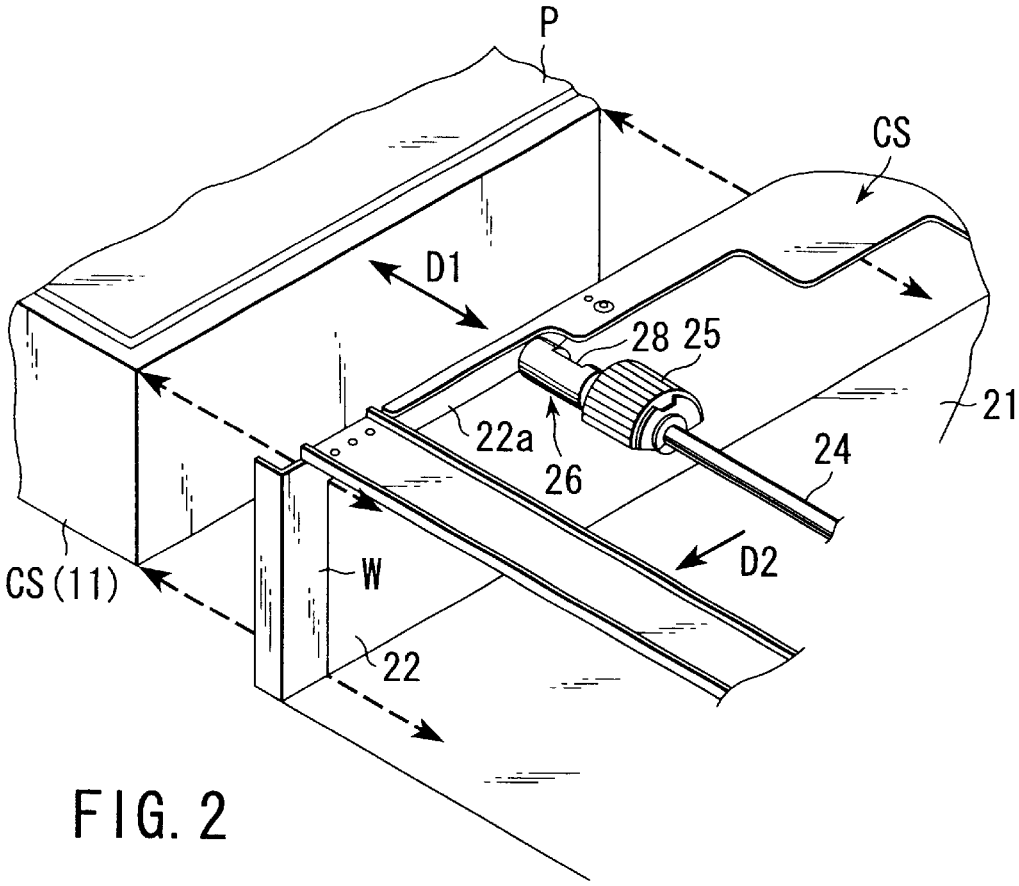
FIG. 2 is a perspective view showing a sheet feeder applied to the facsimile device shown in FIG. 1.
Figure 3:
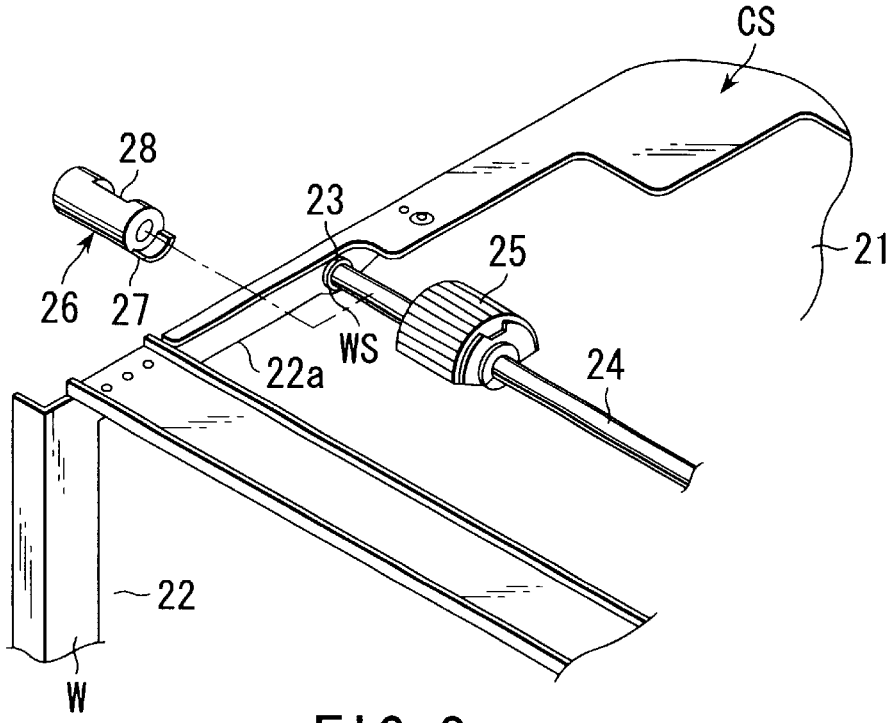
FIG. 3 is an exploded perspective view showing the structure of the sheet feeder of FIG. 2 more in detail.
Figure 4:
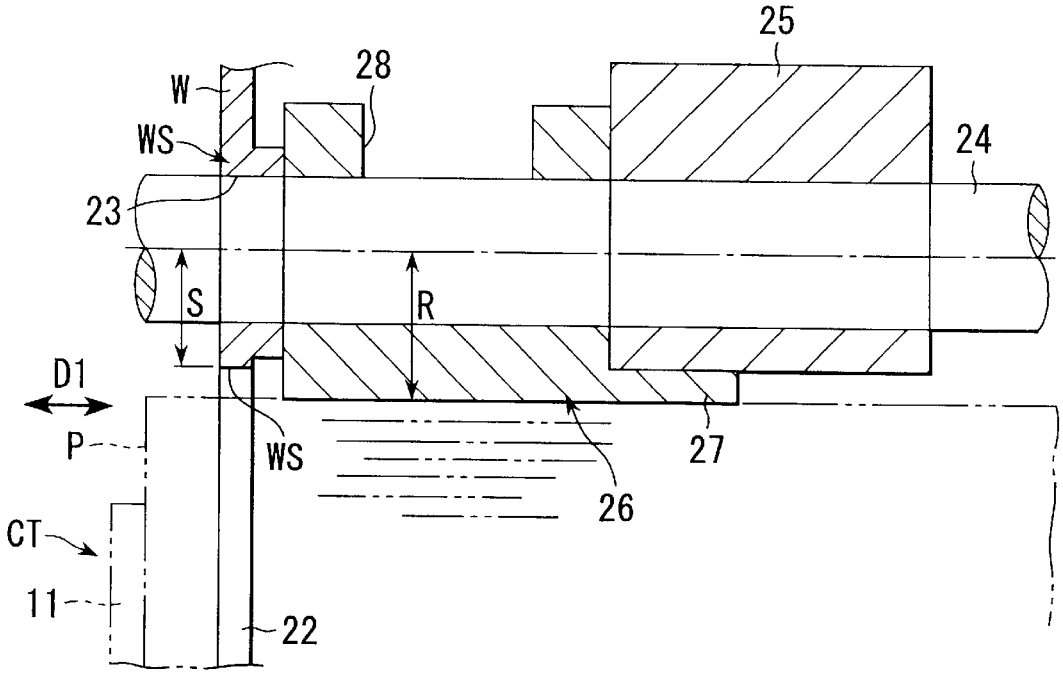
FIG. 4 is a view showing the cross sectional structure of the sheet feeder in a plane parallel to the axis of a roller shaft shown in FIG. 2.

In the feeding mechanism FM, the distance between the cassette attachment port 22 and the bearing hole 23 is large so that the strength of the side wall w will not become insufficient for the roller shaft 25 supported by the bearing holes 23. More specifically, a reinforced wall ring WS with a preset width is provided as a peripheral frame of each bearing hole 23 and projects to partially lower an upper edge 22a of the cassette attachment port 22. If insertion of the sheet tray 11 is disabled due to a projected part of the reinforced wall ring WS brought into contact with the top of the sheet tray 11, a cut-away portion is formed in the sheet tray 11 and set to be in alignment with the projected part of the reinforced wall ring WS. In FIGS. 2 and 3, only one of the bearing holes 23 is shown above the cassette attachment port 22 and the other bearing hole 23 is not shown.

The feeding mechanism FM further includes a rise-spoiling member 26 which is a slick semi-cylindrical member formed of synthetic resin, for example. The rise-spoiling member 26 is attached to the roller shaft 24 and extends from the pickup roller 25 to the reinforced wall ring WS provided in the side wall W of the main body case CS. As shown in FIG. 3, the semi-cylindrical member of the rise-spoiling member 26 contains an arc-form engagement projection 27 engaged with the small-diameter portion 25*b* of the pickup roller 25, and is rotated together with the pickup roller 25. The rise-spoiling member 26 has a radius R larger than a distance S from the center of the bearing hole 23 to the lower end of the reinforced wall ring WS, which projects to partially lowers the upper edge 22*a* of the cassette attachment port 22. Therefore, the rise-spoiling member 26 is set to have a thickness larger than the distance between the roller shaft 24 and the cassette attachment port 22 and prevents the sheets from rising between the side wall W of the case CS and the pickup roller 25 when the sheet storage cassette is withdrawn from the cassette attachment port 22. In this case, the radius R is smaller than the radius of the large-diameter portion 25*a* of the pickup roller 25 and larger than the radius of the small-diameter portion 25*b*. Further, the rise-spoiling member 26 contains an opening portion 28 formed to partially expose the roller shaft 24. The uppermost recording sheet P tends to bend upward and abut against the rise-spoiling member 26 due to a resistance of the separation pawl 16 caused when it is fed by rotation of the pickup roller 25. Therefore, the opening portion 28 is formed to absorb the bending of the uppermost recording sheet P so as not to cause any problem in the sheet feeding process.

Next, the operation of the sheet feeder is explained. For attaching the sheet storage cassette CT, the user previously puts a stack of recording sheets P on the supporting plate 12 and pushes down the recording sheets P together with the supporting plate 12 to the lowest position against the elastic force of the elastic member 13. The hooking pawl 14 of the sheet storage cassette CT hooks the supporting plate 12 in the lowest position. At this time, the uppermost one of the recoding sheets P comes below the separation pawl 16. Then, the sheet storage cassette CT is inserted into the cassette attachment port 22 of the facsimile device in the attachment and detachment direction D1 perpendicular to the sheet feeding direction D2 and attached to the receiving section 21 in the main body case CS. When the attachment is completed, the releasing member 15 releases the hooking member 14. As a result, the supporting plate 12 is pushed up again by the elastic force of the elastic member 13 to set the uppermost one of the recording sheets P to the highest position, which is set near the pickup roller 25 and restricted by the separation pawl 16.

At the printing time, the driving unit RM drives the roller shaft 24 to rotate the pickup roller 25 together with the roller shaft 24 in one direction. The large-diameter portion 25*a* of the pickup roller 25 is moved downwardly according to the rotation and brought into contact with the uppermost one of the recording sheets P to push down the supporting plate 12 against the elastic force of the elastic member 13. As a result, the pickup roller 25 takes out the uppermost recording sheet P from the sheet storage cassette CT in the sheet feeding direction D2. When force in the sheet feeding direction D2 is applied to the recording sheets by rotation of the pickup roller 25, the recording sheets P have been engaged with the separation pawl 16 of the sheet storage cassette CT. Therefore, upward bending occurs in the recording sheet P by the action of the separation pawl 16, but since the opening portion 28 of the rise-spoiling member 26 absorbs the bending, the recording sheet P can be smoothly taken out. Upon completion of printing, the rotations of the roller shaft 24 and pickup roller 25 are stopped such that the small-diameter portion 25*b* of the pickup roller 25 faces the uppermost one of the recording sheets P without being brought into contact therewith.

At the time of detaching the sheet storage cassette CT, the user withdraws the sheet storage cassette CT to the exterior of the cassette attachment port 22 in the attachment and detachment direction D1. At this time, the recording sheets P in the sheet storage cassette CT pass below the rise-spoiling member 26 attached to the roller shaft 24 between the side wall W of the main body case CS and the pickup roller 25.

More specifically, the rise-spoiling member 26 extends from the pickup roller 25 to the reinforced wall ring WS and is brought into contact with the uppermost one of the recording sheets P to hold down the recording sheets P and supporting plate 12 against the upward elastic force applied from the elastic member 13. The rise-spoiling member 26 has a radius R larger than the distance S between the center of the bearing hole 23 and the lower end of the reinforced wall ring WS which projects to the largest extent under the bearing hole 23 so as to partially lower the upper edge 22*a* of the cassette attachment port 22. As a result, the circumferential surface of the rise-spoiling member 26 extrudes downward to a position below the lower end of the reinforced wall ring wS, thereby causing the uppermost one of the recording sheets P to be kept in position below the lower end of the reinforced wall ring WS. Therefore, the recording sheets P are moved from the pickup roller 25 to the cassette attachment port 22 without rising above the lower end of the reinforced wall ring WS, and pass through the cassette attachment port 22 without being caught by the reinforced wall ring WS. Accordingly, it is possible to reliably prevent a sheet jam caused when the end portion of the recording sheet P is caught by the side wall W of the main body case CS located above the cassette attachment port 22.

In the sheet feeder 1, since the sheet storage cassette CT can be easily withdrawn as described above, the recording sheets P can be prevented from being separated from the sheet storage cassette CT or torn when the sheet storage cassette CT is withdrawn. Further, since the sheet feeder 1 does not require a troublesome task of withdrawing the sheet storage cassette CT while manually holding down the recording sheets P together with the supporting plate 12, the load on the user can be alleviated.

Particularly, when the reinforced wall ring WS is provided, it partially lowers the upper edge 22*a* of the cassette attachment port 22, thereby causing a sheet jam to easily occur. However, since the rise-spoiling member 26 is constructed as described above, the sheet storage cassette CT can be easily withdrawn without causing occurrence of a sheet jam.

The recording sheets P can be held down by use of a rise-spoiling member directly attached to the side wall W of the main body case CS, but in this structure, there is a possibility that the rise-spoiling member is detached from the side wall w during the sheet feeding process due to the resistance of the recording sheet P in the feeding direction D2. Therefore, it is preferable that the rise-spoiling member be rotatable as described in the above embodiment. Further, the resistance of the recording sheet P increases in accordance with an increase in the amount of extrusion of the rise-spoiling member from the upper edge 22*a* of the cassette attachment port 22. Therefore, it is preferable that the amount of extrusion be determined not to lower the smoothness in the withdrawal of the sheet storage cassette CT.

Further, in the above embodiment, the rise-spoiling member 26 has a thickness adapted to the lower end position of the reinforced wall ring WS is located, but if the strength of the side wall W is sufficiently large so as not to require the reinforced wall ring WS, the thickness of the rise-spoiling member 26 can be changed so as to be adapted to the position of the upper edge 22*a* of the cassette attachment port 22 which is not partially lowered. That is, this invention can be widely applied to a structure in which the end portion of each recording sheet P is caught by the side wall W of the main body case CS to cause occurrence of a sheet jam when the sheet storage cassette CT is withdrawn.

Further, the sheet feeder 1 is used for feeding a stack of the recording sheets P one by one to the printing unit in the above embodiment, but this invention can be applied to a sheet feeder used for feeding a stack of original documents one by one to a document reading unit, for example. In addition, the rise-spoiling member 26 is not limited to the cylindrical form and can be formed to have a polygonal cross section or in an impeller form, for example.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A sheet feeder comprising:

a sheet storage cassette for storing a stack of sheets and pushing up the sheets by elastic force;

a case having a cassette attachment port through which said sheet storage cassette is detachably attached; and a feeding mechanism for feeding each of the sheets stored in said sheet storage cassette attached to an internal place of said cassette attachment port in a sheet feeding direction substantially perpendicular to an attachment and detachment direction of said sheet storage cassette;

wherein said feeding mechanism includes:

a roller shaft disposed above the sheet storage cassette attached to the internal place of said cassette attachment port and extending in the attachment and detachment direction of said sheet storage cassette from a side wall of said case;

a pickup roller rotated for taking out the uppermost one of the sheets stored in said sheet storage cassette attached to the internal place of said cassette attachment port; and a rise-spoiling member attached to said roller shaft, for spoiling a rise of the sheets when said sheet storage cassette is withdrawn from said cassette attachment port, said rise-spoiling member extruding downward to a position below an upper edge of said cassette attachment port and extending from said pickup roller to the vicinity of the side wall of said case.

2. The sheet feeder according to claim 1, wherein the side wall of said case has a bearing hole arranged above said cassette attachment port, for supporting said pickup roller, and said rise-spoiling member is a semi-cylindrical member having a radius larger than a distance from the center of said roller shaft to the upper edge of said cassette attachment port.

3. The sheet feeder according to claim 2, wherein said rise-spoiling member extends is rotatable on said roller shaft.

4. The sheet feeder according to claim 3, wherein said rise-spoiling member has a structure engaged with said pickup roller to be rotated together with said pickup roller.

5. The sheet feeder according to claim 4, wherein said rise-spoiling member has an opening for absorbing bending of the sheet caused when the sheet is taken out in the sheet feeding direction.

6. The sheet feeder according to claim 1, wherein the rise-spoiling member has a smooth surface.

* * * * *